US007401990B2

(12) United States Patent
Siegel et al.

(10) Patent No.: US 7,401,990 B2
(45) Date of Patent: Jul. 22, 2008

(54) PAPER PATH CALIBRATION AND DIAGNOSTIC SYSTEM

(75) Inventors: Robert P. Siegel, Penfield, NY (US); Ewart O. LeBlanc, Fairport, NY (US)

(73) Assignee: Xerox Corporation, Norwalk, CT (US)

( * ) Notice: Subject to any disclaimer, the term of this patent is extended or adjusted under 35 U.S.C. 154(b) by 704 days.

(21) Appl. No.: 10/760,851

(22) Filed: Jan. 20, 2004

(65) Prior Publication Data

US 2005/0156374 A1 Jul. 21, 2005

(51) Int. Cl.
*B41J 11/42* (2006.01)

(52) U.S. Cl. ..... 400/579; 399/395; 271/227

(58) Field of Classification Search ..... 400/579; 399/395; 271/227
See application file for complete search history.

(56) References Cited

U.S. PATENT DOCUMENTS 5,094,442 A * 3/1992 Kamprath et al. ..... 271/227
5,313,253 A 5/1994 Martin et al.
5,528,347 A 6/1996 Kamath et al.
5,848,344 A * 12/1998 Milillo et al. ..... 399/395
5,859,440 A 1/1999 Acquaviva
6,137,989 A 10/2000 Quesnel
6,168,153 B1 1/2001 Richards et al.
6,173,952 B1 1/2001 Richards et al.
6,388,749 B1 * 5/2002 Yamashita et al. ..... 356/430
6,488,275 B2 * 12/2002 Schlageter ..... 271/10.01
6,603,953 B2 * 8/2003 Jewell ..... 399/395
6,666,600 B1 * 12/2003 Shirota et al. ..... 400/579

* cited by examiner

*Primary Examiner*—Minh H Chau

(57) ABSTRACT

A plurality of scanner bars is arranged in precisely located holes in the frame of a media handling device to detect the passage of the lead and trail edge of media. The multiplicity of scanner bars, arranged linearly at a right angle to the direction of motion of the media, is sampled at some frequency. The scanner bars give not only arrival and departure time of the media from each scanner bar location, but also making some assumptions about the shape of the media, information about the orientation of the media relative to the direction of motion. This information can be used to diagnose improper media handling mechanisms upstream of the sensor or provide information to downstream corrective mechanisms. Pre-printed test media, such as, ladder charts, etc., can be used to extract velocity profiles and other paper path dynamic characteristics.

3 Claims, 3 Drawing Sheets

PAPER PATH CALIBRATION AND DIAGNOSTIC SYSTEM

BACKGROUND OF THE INVENTION

1. Field of the Invention

This disclosure relates to media handling within a printing apparatus, and more particularly, to a calibration and diagnostic system for use within the paper path of a printing apparatus to determine media speed characteristics, position in the paper path and skew.

2. Description of Related Art

In a typical electrophotographic printing process, a photoconductive member is charged to a substantially uniform potential so as to sensitize the surface thereof. The charged portion of the photoconductive member is exposed to a light image of an original document being reproduced. Exposure of the charged photoconductive member selectively dissipates the charges thereon in the irradiated areas. This records an electrostatic latent image on the photoconductive member corresponding to the information areas contained within the original document. After the electrostatic latent image is recorded on the photoconductive member, the latent image is developed by bringing a developer material into contact therewith. Generally, the developer material comprises toner particles adhering triboelectrically to carrier granules. The toner particles are attracted from the carrier granules to the latent image forming a toner powder image on the photoconductive member. The toner powder image is then transferred from the photoconductive member to a copy sheet. The toner particles are heated to permanently affix the powder image to the copy sheet. Such an electrophotographic printing process is shown in U.S. Pat. No. 6,137,989, which is incorporated herein by reference.

In high-speed media or paper handling applications, it is very difficult to diagnose the root cause of any problems because it is essentially impossible to see what is going on inside the machine. This is both because the physical space within the machine is so tight that what one can see is limited, plus the fact that the paper is moving so quickly. Typically, all diagnostics are performed by looking at sheet arrival and departure times at various discrete sensors. No information about paper skew is generally available. Other defects, such as, smear or paper damage must be solved indirectly.

U.S. Pat. No. 5,313,253 issued May 17, 1994 to Michael J. Martin et al. is concerned with paper path signature analysis and discloses an apparatus which utilizes output from various idler rolls throughout the machine paper path to detect abnormalities. The constantly monitored and instantaneous velocity reading are compared with a base line velocity signature established at the factory. If the constantly monitored velocity profile is not within the pre-established operation parameters as set at the factory, automatic machine adjustment procedures are initiated and/ort automatic service alerts are issued.

A method of changing the reference timing of a sheet transport control in an imaging forming device for determining the validity of the timing of a sheet by comparing the actual timing of a sheet with a given reference timing is shown in U.S. Pat. No. 5,528,347 issued Jun. 18, 1996. Actual timings for a plurality of copy sheets in relation to a predetermined sensor are stored in memory. A typical time period from a plurality of copy sheets is then determined in relation to the sensor and the reference timing for the sensor is adjusted based upon the typical time period for the sensor.

U.S. Pat. No. 5,859,440 issued Jan. 12, 1999 to Thomas Acquaviva discloses a dual mode non-contact optical sheet edge detection system for detecting either fully transparent or regular sheet being fed in a sheet transport of a reproduction system. The system utilizes an illumination source for illuminating the potential sheet edge area at an angle to generate a detectable sheet edge shadow from transparent sheets, and an optical detection system remotely detecting the generated edge shadow to provide sheet edge location or timing information to a control system. Preferably, the sheet edge is held spaced above the illuminated sensor and illuminated target area to enhance the shadow effect.

An apparatus and method for correcting top edge sheet misregistration using a sensor array is disclosed in U.S. Pat. No. 6,137,989 issued Oct. 24, 2000 to Lisbeth S. Quesnel. An array sensor is placed in the paper path prior to transfer. A signal is generated indicating the position of the sheet. As a function of the signal, the print controller causes the image to be exposed and developed on the photoreceptor in alignment with the sheet position. The aligned image is then transferred to the sheet.

U.S. Pat. Nos. 6,168,153 B1 and 6,173,952 B1 issued Jan. 2, 2001 and Jan. 16, 2001, respectively, to Paul N. Richards et al. disclose a sheet handling system for correcting the skew and/or transverse position of sequential sheets, especially those moving in a process direction in a sheet transport of a reproduction apparatus. The system employs sensor arrays in deskewing and/or side registering sheets.

Some of these technologies are quite sophisticated, utilizing various embedded sensors, digitally controllable stepper motors and high speed computational capability, all of which add up to a significant level of equipment cost, which, while justified in a high-end printer, might be considered exorbitant in a smaller, less expensive device.

Furthermore, while these systems provide control over certain aspects of machine behavior that are designed to be controlled, there will always be unintended sources of variation due to various types of defects and malfunctions which these systems can neither compensate for, nor diagnose.

Even though the above-mentioned prior art is useful, there is still a need, in printers for improvements in paper path diagnostic systems.

Accordingly, a paper path and diagnostic system is disclosed that answers the above-mentioned problem by using precisely aligned slots strategically placed in the frame of a printer along its paper path and positioning scanner bars within those slots to "watch" the paper as it goes by. The scanner bars will monitor the paper as it is fed, looking for any irregularities, such as, skew at each station. If, for example, skew is detected, detailed information is included in the scanner data to help identify the associated vectors and root cause of the skew. If ladder chart paper is used, the velocity of the sheet and the motion quality information can also be extracted.

BRIEF DESCRIPTION OF THE DRAWINGS

The foregoing and other features of the disclosure will be apparent and easily understood from a further reading of the specification, claims and by reference to the accompanying drawings in which like reference numerals refer to like elements and wherein:

Figure 1:
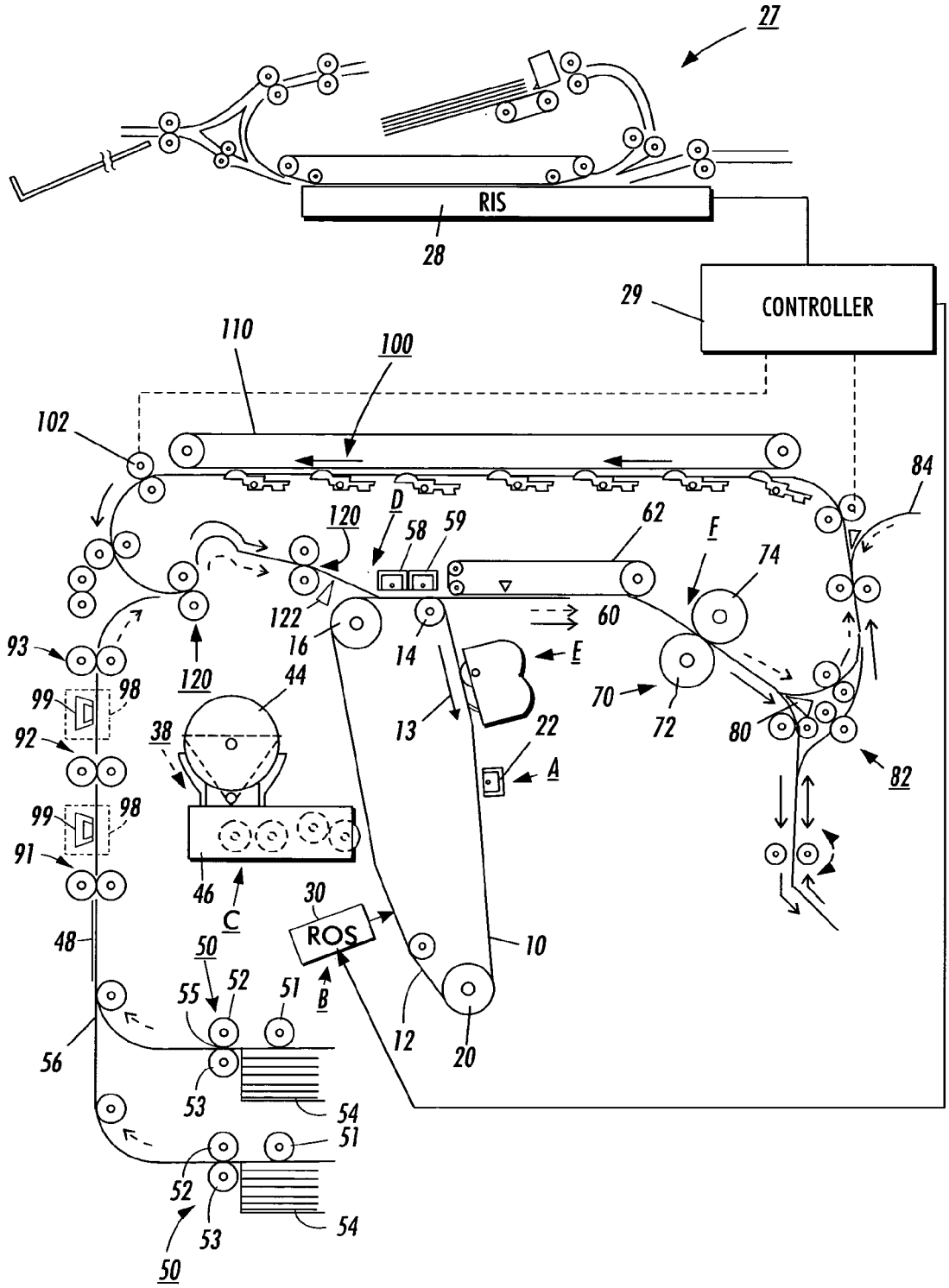
FIG. 1 is a schematic elevational view of a typical electrophotographic printing machine that includes a paper path calibration and diagnostic system.

While the disclosure will be described hereinafter in connection with a preferred embodiment thereof, it will be understood that limiting the disclosure to that embodiment is not intended. On the contrary, it is intended to cover all alternatives, modifications and equivalents as may be included within the spirit and scope of the invention as defined by the appended claims.

DETAILED DESCRIPTION OF THE INVENTION

The disclosure will now be described by reference to a preferred embodiment of the paper path calibration and diagnostic system of a printing machine. However, it should be understood that the disclosed paper path calibration and diagnostic system could be used with any machine in which a precision paper path setup is desired.

For a general understanding of the features of the disclosure, reference is made to the drawings. In the drawings, like reference numerals have been used throughout to identify identical elements.

Referring to FIG. 1 of the drawings, an original document is positioned in a document handler 27 on a raster input scanner (RIS) indicated generally by reference numeral 28. The RIS contains document illumination lamps, optics, a mechanical scanning drive and a charge couple device (CCD) array. The RIS captures the entire original document and converts it to a series of raster scan lines. This information is transmitted to an electronic subsystem (ESS) which controls a raster output scanner (ROS) described below.

FIG. 1 schematically illustrates an electrophotographic printing machine which generally employs a photoconductive belt 10. Preferably, the photoconductive belt 10 is made from photoconductive material coated on a ground layer, which, in turn, is coated on an anti-curl backing layer. Belt 10 moves in the direction of arrow 13 to advance successive portions sequentially through the various processing stations disposed about the path of movement thereof. Belt 10 is entrained about stripping roller 14, tensioning roller 20 and drive roller 16. As roller 16 rotates, it advances belt 10 in the direction of arrow 13.

Initially, a portion of the photoconductive surface passes through charging station A. At charging station A, a corona generating device indicated generally by the reference numeral 22 charges the photoconductive belt 10 to a relatively high, substantially uniform potential.

At an exposure station, B, a controller or electronic subsystem (ESS), indicated generally by reference numeral 29, receives the image signals representing the desired output image and processes these signals to convert them to a continuous tone or grayscale rendition of the image which is transmitted to a modulated output generator, for example the raster output scanner (ROS), indicated generally by reference numeral 30. Preferably, ESS 29 is a self-contained, dedicated minicomputer. The image signals transmitted to ESS 29 may originate from a RIS as described above or from a computer, thereby enabling the electrophotographic printing machine to serve as a remotely located printer for one or more computers. Alternatively, the printer may serve as a dedicated printer for a high-speed computer. The signals from ESS 29, corresponding to the continuous tone image desired to be reproduced by the printing machine, are transmitted to ROS 30. ROS 30 includes a laser with rotating polygon mirror blocks. The ROS will expose the photoconductive belt to record an electrostatic latent image thereon corresponding to the continuous tone image received from ESS 29. As an alternative, ROS 30 may employ a linear array of light emitting diodes (LEDs) arranged to illuminate the charged portion of photoconductive belt 10 on a raster-by-raster basis.

After the electrostatic latent image has been recorded on photoconductive surface 12, belt 10 advances the latent image to a development station, C, where toner, in the form of liquid or dry particles, is electrostatically attracted to the latent image using commonly known techniques. The latent image attracts toner particles from the carrier granules forming a toner powder image thereon. As successive electrostatic latent images are developed, toner particles are depleted from the developer material. A toner particle dispenser, indicated generally by the reference numeral 44, dispenses toner particles into developer housing 46 of developer unit 38.

With continued reference to FIG. 1, after the electrostatic latent image is developed, the toner powder image present on belt 10 advances to transfer station D. A print sheet 48 is advanced to the transfer station, D, by a sheet feeding apparatus, 50. Preferably, sheet feeding apparatus 50 includes a nudger roll 51 which feeds the uppermost sheet of stack 54 to nip 55 formed by feed roll 52 and a retard roll 53. Feed roll 52 rotates to advance the sheet from stack 54 into vertical transport 56. Vertical transport 56 directs the advancing sheet 48 of support material into the registration transport 120 which, in turn, advances the sheet 48 past image transfer station D to receive an image from photoconductive belt 10 in a timed sequence so that the toner powder image formed thereon contacts the advancing sheet 48 at transfer station D. Transfer station D includes a corona generating device 58 which sprays ions onto the back side of sheet 48. This attracts the toner powder image from photoconductive surface 12 to sheet 48. The sheet is then detacked from the photoreceptor by corona generating device 59 which sprays oppositely charged ions onto the back side of sheet 48 to assist in removing the sheet from the photoreceptor. After transfer, sheet 48 continues to move in the direction of arrow 60 by way of belt transport 62, which advances sheet 48 to fusing station F.

Fusing station F includes a fuser assembly indicated generally by the reference numeral 70 which permanently affixes the transferred toner powder image to the copy sheet. Preferably, fuser assembly 70 includes a heated fuser roller 72 and a pressure roller 74 with the powder image on the copy sheet contacting fuser roller 72. The pressure roller is cammed against the fuser roller to provide the necessary pressure to fix the toner powder image to the copy sheet. The fuser roll is internally heated by a quartz lamp (not shown). Release agent, stored in a reservoir (not shown), is pumped to a metering roll (not shown). A trim blade (not shown) trims off the excess release agent. The release agent transfers to a donor roll (not shown) and then to the fuser roll 72.

The sheet then passes through fuser 70 where the image is permanently fixed or fused to the sheet. After passing through fuser 70, a gate 80 either allows the sheet to move directly via output 84 to a finisher of stacker, or deflects the sheet into the duplex path 100, specifically, first into single sheet inverter 82 here. That is, if the sheet is either a simplex sheet or a completed duplex sheet having both side one and side two images formed thereon, the sheet will be conveyed via gate 80 directly to output 84. However, if the sheet is being duplexed and is then only printed with a side one image, the gate 80 will be positioned to deflect that sheet into the inverter 82 and into the duplex loop path 100, where that sheet will be inverted and then fed to acceleration nip 102 and belt transport 110, for recirculation back through transport station D and fuser 70 for receiving and permanently fixing the side two image to the backside of that duplex sheet, before it exits via exit path 84.

After the print sheet is separated from photoconductive surface 12 of belt 10, the residual toner/developer and paper fiber particles adhering to photoconductive surface 12 are removed therefrom at cleaning station E. Cleaning station E includes a rotatably mounted fibrous brush in contact with photoconductive surface 12 to disturb and remove paper fibers and a cleaning blade to remove the non-transferred toner particles. The blade may be configured in either a wiper or doctor position depending on the application. Subsequent to cleaning, a discharge lamp (not shown) floods photoconductive surface 12 with light to dissipate any residual electrostatic charge remaining thereon prior to the charging thereof for the next successive imaging cycle.

The various machine functions are regulated by controller 29. The controller is preferably a programmable microprocessor that controls all of the machine functions hereinbefore described. The controller provides a comparison count of the copy sheets, the number of documents being recirculated, the number of documents being recirculated, the number of copy sheets selected by the operator, time delays, jam corrections, receive signals from full width or partial width array sensors and calculate skew in sheets passing over the sensors, calculate the change in skew, the speed of the sheet and an overall comparison of the detected motion of sheets with a reference or nominal motion through a particular portion of the machine.

Figure 2:
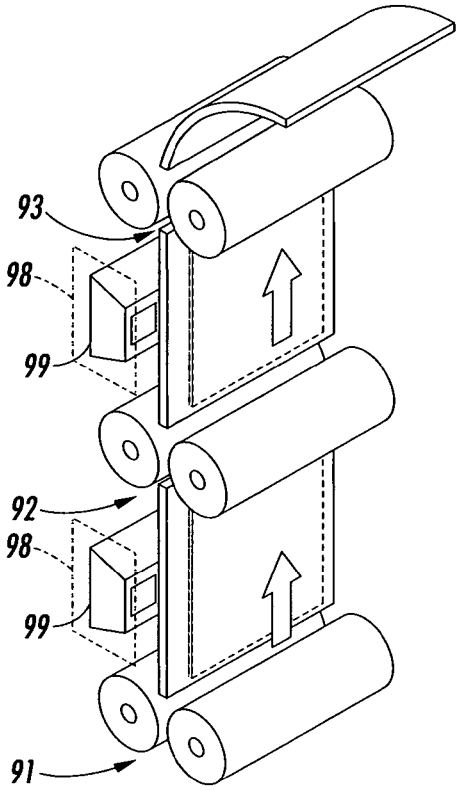
FIG. 2 is a schematic partial perspective view of a portion of the paper path of the printer apparatus of FIG. 1 incorporating scanner bars at predetermined locations.

As illustrated in FIG. 2, an inexpensive system calibration and verification procedure to be performed at the end of the production of printers or other machines and as a field diagnostic tool includes a paper sheet transport of a conventional printer supported by a machine frame member that includes slots 98. As shown, paper is driven through the paper path of the printer for later processing by drive roll nips 91, 92 and 93. The drive roll nips propel the sheets through baffles en route to a transfer station D. Precision slots 98 or other mounting provisions are cut or attached into the machine frame at predetermined locations along the paper path and adapted to support scanner bars 99 therein such that the scanner bars can be mounted there so as to monitor each sheet that passes thereunder. The scanner bars 99 are used in a system calibration and verification procedure to be performed at the end of the production and as a field diagnostic tool and gives an actual image of a sheet instead of an image of one side of the sheet. Since the system is designed to accommodate the scanners, they can be installed with high precision. However, since they are only used for initial machine setup and periodic adjustment, and then removed, they are not part of the machine's cost.

Figure 3:
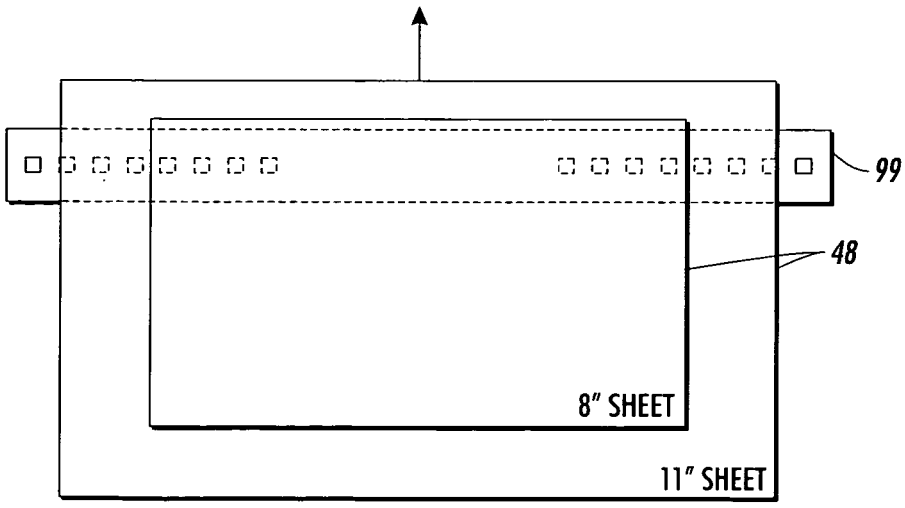
FIG. 3 is a view of a scanner bar looking through copy sheets showing active areas and paper sizes covered.

Each scanner bar 99 is a charge coupled, or similar, device which has an image sensing area consisting of a variable number of horizontal image lines each containing a variable number of photosensitive elements or pixels. A single scanner bar would have n×1 number of pixels, for instance. As shown in FIG. 3, the required width of the scanner bar depends on the variation in paper sizes and also on whether the paper path is edge or center registered. An edge registered paper path requires a very small scanner bar (or partial width array). For instance, if the expected input variation were +/−10 mm, then the scanner bar would be 20 mm. A center registered paper path, such as the XEROX 265DC printer, requires a wider scanner bar. The input variation is added to the variation in paper widths. For instance, to correct for sheets with a width range of A5 to 11 inches wide, the scanner bar should be 35 mm wide plus the expected misregistration, or 35+20=55 mm.

Scanner bars 99 can be used either in a reflective mode or in a transmissive mode. In the reflective mode, light is emitted from LED's or other light sources, reflects off the paper or other sheet medium, and is reflected back to the pixels, generating a charge level in each pixel. The charge level is proportional to the amount of light reflected and the length of exposure time. This value is then determined for each pixel. The pixels, which are covered by the edges of the paper, will have different values than the pixels left uncovered. Provisions are made on the opposing baffle, such as a black patch, to provide a reflection that could be distinguished from the paper as it goes by. In the transmissive mode, the paper is located between the light source and the pixels. The mode normally used is the auto-reflective mode. It should be understood that scanner bars 99 could also be butted silicon arrays or whatever technology is most appropriated at the time of implementation and could also extend across the full width of the paper path.

In the final calibration verification mode after manufacture or remanufacture of a machine has been completed, scanner bars 99 are inserted into the slots in the predetermined positions within the machine's paper path and connected to the FCV tool interface. Sheets are monitored as they are fed, looking for any irregularities, such as, skew at each station. If excessive skew is detected, or other irregularity in the motion or position of the sheet, detailed information will be included in the scanner data to help identify the root cause of the problem. If ladder chart paper is used, a detailed velocity profile of the sheet and motion quality information can also be extracted. Velocity constraints, which compensate for variations in drive roll diameter and motor speed, can be written into the machine's non-volatile memory and stored for use by the machine controller to customize machine timing and jam logic. Once the test calibration is completed, the scanner bars are removed and the machine is shipped.

In the field service mode, the customer service engineer would carry a single portable scanner bar that he or she would insert into the slot in whatever zone that the paper-handling problems have been reported. The CSE would then run paper through the machine and using either a portable interface or an interface provided within the machine (or a combination of the two) and would acquire detailed image data that would be very useful in diagnosing the root cause of paper jams or skew in the machine. In high-end machines that typically operate at faster speeds within more sophisticated paper paths, one embodiment of the field service mode can incorporate a number of portable scanners working in tandem between major modules and/or subsystems. This will support rapid troubleshooting and identification of root causes.

Typically, a number of sheets would be measured and statistical analysis performed. If there is an overall mean skew and/or misregistration, these can be corrected, either through mechanical adjustment in those machines with basic registration systems, or through control subsystems parameter updates, in more sophisticated systems. If the performance deviation is beyond the range of adjustment, diagnostic algorithms will initiate further tests as required or directly identify which part or parts need to be replaced.

Figure 4:
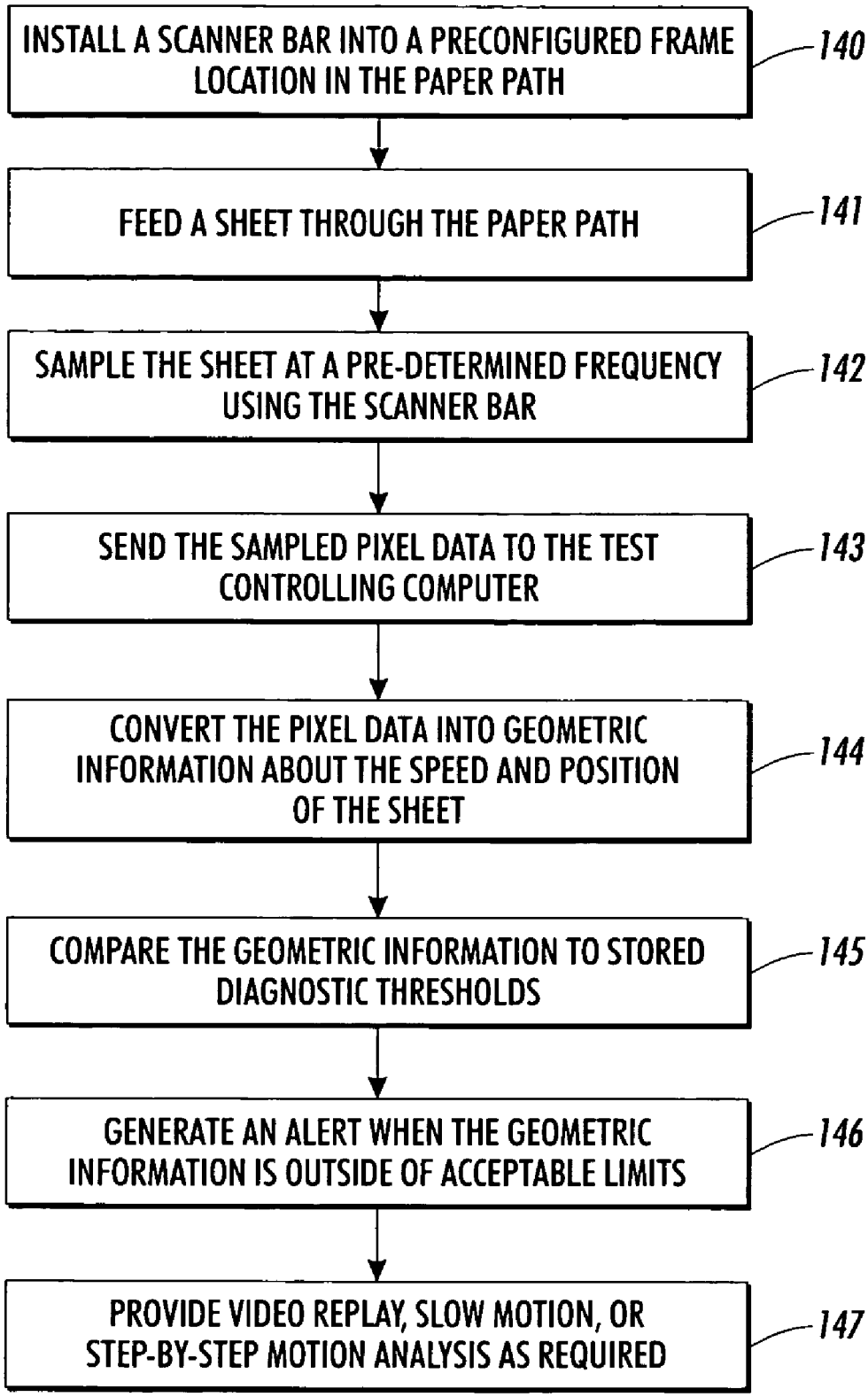
FIG. 4 is a block diagram depicting the function of the scanner bars used in FIG. 1.

As depicted in the flow chart in FIG. 4, once a machine reaches the end of an assembly line and is ready for testing or when a skew problem is noticed in the field, a removable scanner bar 99 in block 140 is placed in each of strategically positioned slots 98 and adapted to monitor sheets as they pass thereunder. As sheets are fed as indicated by block 141, each sheet is sampled in block 142 at a predetermined frequency by the sensors in the bar. As shown in block 143, pixel information signals from each sensor is sent to controller 29 where it is converted in block 144 to skew and other descriptive geometric information. In block 145, the geometric information is compared with diagnostic thresholds stored in the controller's non-volatile memory. If the received skew information from sensors 99 is not within a predetermined acceptable range as indicated in block 145, a signal indicating such is generated in block 146 by the controller and corrections are made. In cases where detailed analysis is required, video playback, either at normal speed, in slow motion or in a step by step fashion can be provided as shown in block 147.

It should now be understood that a paper path calibration and diagnostic system has been disclosed that include a series of scanner bars positioned within slots at precise locations within the paper path of a printer. From measurements using the scanner bars during FVC, calibration constants are entered into the printer's NVM for skew adjustments. The scanner bars can be removed after the procedure.

While a paper path calibration and diagnostic system has been described in conjunction with the specific embodiments outlined above, it is evident that many alternatives, modifications and variations will be apparent to those skilled in the art. Accordingly, the preferred embodiments as set forth above are intended to be illustrative and not limiting. Various changes may be made without departing from the spirit and scope of the invention as defined herein.

What is claimed is:

1. A method for use by a customer service engineer in field diagnosing media skew in the paper path of a printer, comprising:

providing a frame for supporting the paper path structure of the machine;

providing a slot within said frame positioned adjacent said paper path;

inserting only while diagnosing in the field a removable scanner bar that is not intended to be a permanent part of said printer into said slot;

generating a signal indicative of the inboard and outboard edge skew of media passing by said removable scanner bar;

providing a controller adapted to receive said signals from said removable scanner bar and comparing the received signals with an acceptable skew range and indicating whether said signals are within or outside acceptable skew range; and removing said scanner bar after skew diagnosing is complete.

2. The method of claim 1, including providing video replay analysis as required.

3. The method of claim 2, including providing said video replay in slow motion.

* * * * *